US011143441B2

(12) United States Patent
Ishisaka

(10) Patent No.: US 11,143,441 B2
(45) Date of Patent: Oct. 12, 2021

(54) CLOSED LOOP REFRIGERATION SYSTEM

(71) Applicant: Toyo Engineering Corporation, Tokyo (JP)

(72) Inventor: Takuya Ishisaka, Narashino (JP)

(73) Assignee: TOYO ENGINEERING CORPORATION, Tokyo (JP)

( * ) Notice: Subject to any disclaimer, the term of this patent is extended or adjusted under 35 U.S.C. 154(b) by 196 days.

(21) Appl. No.: 16/617,803

(22) PCT Filed: Aug. 23, 2018

(86) PCT No.: PCT/JP2018/031133
§ 371 (c)(1),
(2) Date: Nov. 27, 2019

(87) PCT Pub. No.: WO2019/049678
PCT Pub. Date: Mar. 14, 2019

(65) Prior Publication Data

US 2020/0149787 A1 May 14, 2020

(30) Foreign Application Priority Data

Sep. 5, 2017 (JP) ..... JP2017-169976

(51) Int. Cl.
*F25B 25/02* (2006.01)
*F25B 1/00* (2006.01)

(52) U.S. Cl.
CPC ..... *F25B 25/02* (2013.01); *F25B 1/00* (2013.01)

(58) Field of Classification Search
CPC ..... F25B 25/02; F25B 1/00; F25B 9/002
See application file for complete search history.

(56) References Cited

U.S. PATENT DOCUMENTS 4,914,921 A * 4/1990 Knodel ..... F25B 1/00 417/68
2005/0103027 A1* 5/2005 Ichijo ..... F25B 25/02 62/112
2005/0155355 A1* 7/2005 Watanabe ..... F25B 23/00 62/4

FOREIGN PATENT DOCUMENTS

JP 57-016289 B2 4/1982
JP 2003-139357 A 5/2003
JP 2004-101138 A 4/2004
JP 2004-101139 A 4/2004
(Continued)

OTHER PUBLICATIONS

Notification of Transmittal of Translation of the International Preliminary Report on Patentability for PCT/JP2018/031133, dated Mar. 19, 2020 (6 pages).
(Continued)

*Primary Examiner* — David J Teitelbaum
(74) *Attorney, Agent, or Firm* — Flynn Thiel, P.C.

(57) ABSTRACT

A closed loop refrigeration system using a gas hydrate having a temperature below 0° C. has: a first circulation loop extending through a gas hydrate formation device 1, an object 2 to be cooled and a separator 3 and back to the formation device 1 and including a gas hydrate line 10 for transporting a gas hydrate having a temperature below 0° C.; and a second circulation loop for gas extending through the formation device 1, a compressor 4, a cooler 5 and a decompressor 6 and back to the formation device 1, wherein an object to be transported in the first circulation loop is transported together with a liquid carrier.

5 Claims, 1 Drawing Sheet

(56) References Cited

FOREIGN PATENT DOCUMENTS

| | | | |
|---|---|---|---|
| JP | 2004-101140 | A | 4/2004 |
| JP | 2006-194549 | A | 7/2006 |
| JP | 2007-322025 | A | 12/2007 |

OTHER PUBLICATIONS

English International Search Report for corresponding PCT/JP2018/031133, dated Nov. 13, 2018 (2 pgs).
Japanese International Search Report and Written Opinion for corresponding PCT/JP2018/031133, dated Nov. 13, 2018 (8 pgs).

* cited by examiner

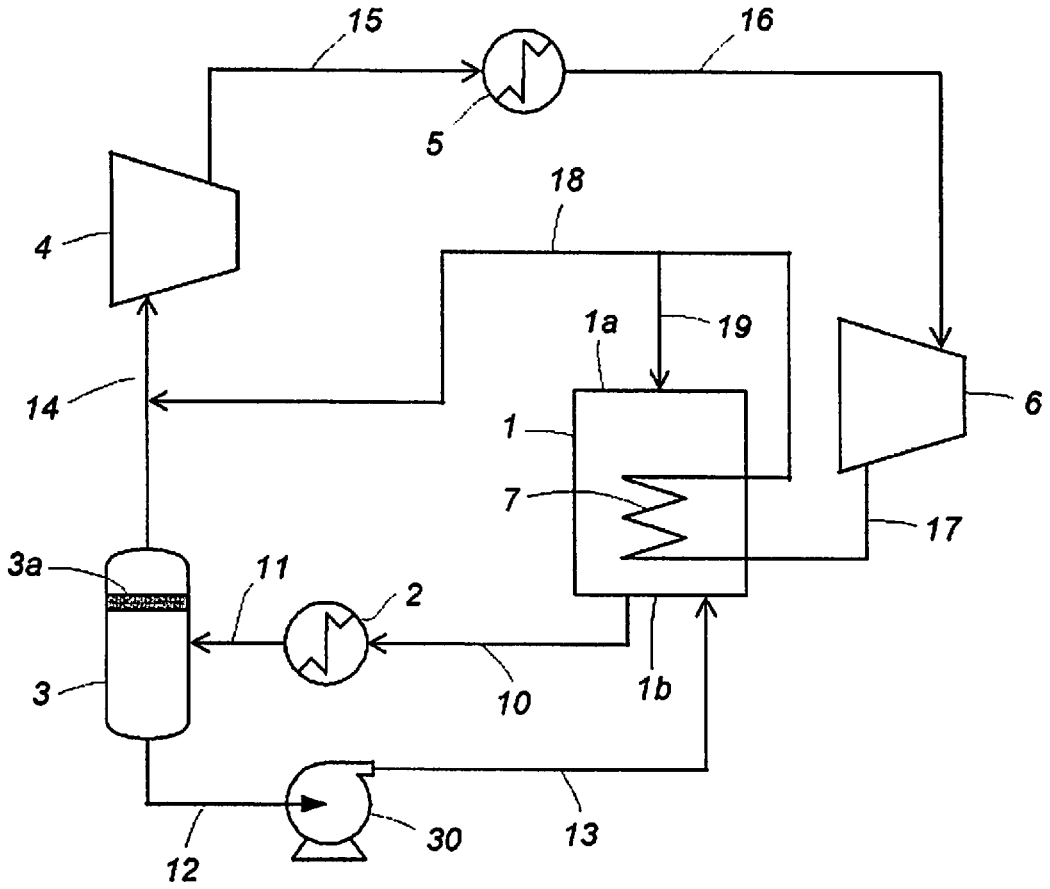
15
16
5
18
4
1a
19
6
14
1
7
17
3a
11
2
3
10
1b
30
13
12

CLOSED LOOP REFRIGERATION SYSTEM

TECHNICAL FIELD

The present invention relates to a closed loop refrigeration system, which is usable in cooling an object to be cooled such as various plants, refrigeration devices, heat pumps, and air-conditioning systems.

BACKGROUND ART

A gas hydrate is an ice-like clathrate compound having gas molecules enclosed in clathrates of water molecules, and it is known as having a property of generating heat at the time of formation and absorbing heat at the time of decomposition.

A refrigeration system utilizing this property of a gas hydrate is known in JP-A 2003-139357, JP-A 2004-101138, JP-A 2004-101139, JP-A 2004-101140, JP-A 2006-194549, and JP-A 2007-322025.

SUMMARY OF INVENTION

The present invention has an object to provide a closed loop refrigeration system that uses a gas hydrate having a temperature below 0° C.

The present invention provides a closed loop refrigeration system having a gas hydrate formation device, an object to be cooled, a separator, a compressor, a cooler and a decompressor, wherein the system has:

a first circulation loop extending through the gas hydrate formation device, the object to be cooled and the separator and back to the gas hydrate formation device and including a gas hydrate line for transporting a gas hydrate having a temperature below 0° C.; and a second circulation loop for gas extending through the gas hydrate formation device, the compressor, the cooler and the decompressor and back to the gas hydrate formation device, wherein the first circulation loop has the gas hydrate line, a mixed phase line for transporting a mixed phase of gas and ice after decomposition of the gas hydrate, and an ice line for transporting ice after the ice is separated from gas by the separator, and an object to be transported in each line of the first circulation line is transported together with a same liquid carrier, and wherein the second circulation loop has a first gas feed line branched between the gas hydrate formation device and the compressor for sending gas to the gas hydrate formation device from the second circulation loop, and a second gas feed line connected for sending the gas separated by the separator to the compressor.

In the closed loop refrigeration system of the present invention, use of a gas hydrate having a temperature below 0° C. and a carrier enables smooth transportation of a gas hydrate and also, use of decomposition latent heat of the gas hydrate can reduce power consumption, also enabling handling of cooling and refrigeration down to about −40° C.

BRIEF DESCRIPTION OF DRAWINGS

FIG. 1 is a schematic view of a closed loop refrigeration system of the present invention.

DESCRIPTION OF EMBODIMENTS

<Closed Loop Refrigeration System>

A closed loop refrigeration system of the present invention is characterized by utilizing a gas hydrate having a temperature below 0° C., and then using a carrier (liquid carrier), which is liquid even below 0° C., as transportation means of the gas hydrate having a temperature below 0° C.

A closed loop refrigeration system shown in FIG. 1 has a first circulation loop and a second circulation loop.

The first circulation loop is a circulation line extending through a gas hydrate formation device (hereinafter, referred to as "formation device") 1, an object 2 to be cooled and a separator 3, and back to the formation device 1, and the circulation is carried out by driving a pump 30. The line is a piping made of a metal such as carbon steel or stainless steel, and it is covered with a heat insulating material if necessary.

The formation device 1 of the first circulation loop is a device for forming therein gas hydrates from ice and gas. The formation device 1 is made of a metal such as carbon steel or stainless steel, and it is a pressure-resistant container having a main body with a cylindrical outer shape or a cylindrical main body, wherein the main body has both end sides with a spherical shape.

The formation device 1 has an input port for feeding ice or water (preferably ice) thereinto at a stage before the start of operation, and the input port has a door that is openable and closable. The door can keep an interior of the formation device 1 in an airtight structure after the feeding of ice.

The formation device 1 has a cooling device 7 provided therein. The cooling device 7 may be any cooling device as long as it can cool an interior of the formation device 1. Usable is a coil-like tube, a waveform tube, a cooling plate obtained by combining a plurality of plates or the like, which allows cooling gas to pass therethrough.

The formation device 1 may be equipped, if needed, with a thermometer, a pressure gauge or the like to measure a temperature, a pressure or the like of the interior of the device and check them from outside.

Examples of the object 2 to be cooled include various plants, various refrigeration devices, heat pumps, and various air-conditioning systems, which require cooling, and they are cooled through a heat exchanger, a cooling tube or the like possessed thereby.

The formation device 1 and the object 2 to be cooled are connected to each other by a gas hydrate transportation line 10, and the gas hydrate is transported together with a carrier for assisting the transportation of the gas hydrate.

Regarding the object 2 to be cooled, there may be one object, and there may be a plurality of objects. When a plurality of objects 2 to be cooled are present, either of the following forms is adopted: the plurality of objects to be cooled are respectively connected from the first circulation loop by individual circulation lines; or the plurality of objects to be cooled are connected by a single circulation line, such as from the first circulation loop to a first object to be cooled, from the first object to be cooled to a second object to be cooled, and from the second object to be cooled to a n-th object to be cooled. Even when a plurality of objects 2 to be cooled are present, their temperature levels can be varied depending on the respective objects to be cooled.

The separator 3 is for separating gas generated by decomposition of a gas hydrate in the process of cooling the object 2 to be cooled, ice, and a carrier in the state of liquid. The object 2 to be cooled and the separator 3 are connected to each other by a mixed phase 11 for transporting a mixed phase of gas and ice after the decomposition of the gas hydrate by the cooling of the object 2 to be cooled.

In addition, the separator 3 and a compressor 4 in the second circulation loop are connected to each other by a second gas line 14. The second gas line 14 may be equipped with a decompressor or a preheater when it is feared that re-condensation of a hydrate may occur due to water components leaked from the separator 3.

Gas, ice and the carrier sent from the mixed phase line 11 to the separator 3 are separated by the gas moving to an upper space of the separator 3 and the ice and the carrier moving to a lower space of the separator 3. A mist eliminator device 3*a* for removing mist may be provided in the separator 3, if necessary.

The pump 30 is provided between the separator 3 and the formation device 1; the separator 3 and the pump 30 are connected to each other by a first ice line 12 for transporting, together with a liquid carrier, the ice separated by the separator 3; and the pump 30 and the formation device 1 are connected to each other by a second ice line 13. The ice returned into the formation device 1 from the first ice line 12 and the second ice line 13 is used again for production of a gas hydrate in the formation device 1.

The second circulation loop is a gas circulation line extending through the formation device 1, the compressor 4, a cooler 5 and a decompressor 6, and back to the formation device 1. The line is a piping made of carbon steel, stainless steel or the like, and is covered with a heat insulating material if necessary.

The compressor 4 is for compressing gas. The level of pressure is determined in consideration of the relationship with the reduced pressure level (gas temperature reduction level by reduced pressure) in the decompressor 6. The formation device 1 and the compressor 4 are connected to each other through the first gas line 18 and the second gas line 14 connected to the first gas line 18.

In addition, in FIG. 1, the compressor 4 and the second gas line 14 are connected to each other, and the first gas line 18 is connected to the second gas line 14. However, the first gas line 18 may be connected to the compressor 4 and the second gas line 14 may be connected to the first gas line 18. Alternatively, the first gas line 18 and the second gas line 14 may be separately connected to the compressor 4.

From the first gas line 18, a gas feed line 19 for feeding gas to the formation device 1 is branched.

The cooler 5 is for cooling gas that has an elevated temperature by being compressed at the compressor 4. The compressor 4 and the cooler 5 are connected to each other through a third gas line 15. As the cooler 5, one having a water cooling system or an air cooling system is usable.

The decompressor 6 utilizes latent heat generated by reducing the pressure of the gas that has been sent from the cooler 5 and is still in a high pressure state, thereby causing a large decrease of gas temperature. The decompressor 6 and the cooler 5 are connected to each other by a fourth gas line 16.

As the decompressor 6, an expander, an expansion valve or the like can be used. In the case of an expander, it can use power obtained thereby as part of a power source of a compressor, and in addition, can reduce a temperature by isentropic expansion more than an expansion valve. Meanwhile, in the case of an expansion valve, it can cause a large reduction in the initial investment cost.

The cooling device 7 in the formation device 1, and the decompressor 6 are connected to each other by a fifth gas line 17, and the cooling device 7 is connected to the first gas line 18. In addition, the fifth gas line has a gas phase or a gas/liquid mixed phase depending upon a temperature level and type of circulating gas.

<Operation Method of Closed Loop Refrigeration System>

A method for operating a closed loop refrigeration system is explained by referring to FIG. 1.

In the operation of the closed loop refrigeration system, operations of the first and second circulation loops are carried out in parallel.

First, gas circulation operation in the second circulation loop will be explained. Regarding gas in the second circulation loop, a predetermined amount thereof is filled at the time of assembling the closed loop refrigeration system. The closed loop refrigeration system shown in FIG. 1 is a closed system after the start of operation, and therefore, it is not necessary to make-up gas unless an abnormality such as a gas leakage occurs.

The gas in the second circulation loop is fed into the formation device 1 from the gas feed line 19 branched from the first gas line 18 for forming a gas hydrate, and in addition, it is used as a refrigerant for the cooling device 7 provided inside the formation device 1.

The gas circulating in the second circulation loop is compressed by the compressor 4 (for example, 10 to 30 MPa); and thereafter, cooled further by isentropic expansion or isenthalpic expansion generated by reducing the pressure of the gas cooled by the cooler 5 (to, for example, 0.3 to 0.9 MPa) by the decompressor 6.

The cooled gas is fed to the cooling device 7 inside the formation device 1, so that an interior of the formation device 1 is cooled by the cooling device 7. The cooling temperature at this time is a temperature that can be maintained within such a temperature range required for heat of decomposition of a gas hydrate, for example, the range from below 0° C. to −40° C.

The gas having passed through the cooling device 7 is sent through the first gas line 18 to the compressor 4, and fed into the formation device 1 as gas for forming a gas hydrate from the gas feed line 19 branched from the first gas line 18 on the way of the first gas line to the compressor.

The second circulation loop including the gas feed line 19 can be appropriately equipped with a gas flowmeter, a pressure gauge or the like.

Next, circulation operation of the first circulation loop will be explained in connection with the above-described circulation operation of the second circulation loop. The formation device 1 is in a closed state wherein a predetermined amount of ice or water is put thereinto in advance. The amount of ice is determined considering the volume of the formation device 1, the refrigeration level for the object 2 to be cooled, the circulation amount inside the first circulation loop, or the like.

In the state wherein ice is put into the formation device 1, gas is blown into the formation device 1 from the gas feed line 19 branched from the first gas line 18 to bring into contact with the ice. Blowing of gas causes a high pressure inside the formation device 1, thereby forming a gas hydrate.

Examples of usable gas include hydrocarbons such as methane, ethane, ethylene, propane and propylene, carbon dioxide, nitrogen, air, ammonia, and xenon; however, it is not limited as long as it can produce a gas hydrate having a temperature below 0° C. Further, as for the type of a hydrate, there is no limitation among Structure I, II and H, and it may be selected considering the temperature/pressure level to be applied, and the quantity of heat. In the present invention, methane, propane, propylene, carbon dioxide or mixture thereof are preferred.

Heat of formation generated when a gas hydrate is formed in the formation device 1 can be used for heat-exchange with a cooling medium (water, sea water, brine, etc.) outside the formation device 1. However, in the closed loop refrigeration system shown in FIG. 1, the cooling device 7 in the second circulation loop uses latent heat and sensible heat of the fifth gas line 17 for cooling.

In addition, when an external cooling medium (LNG, etc.) is present, the cold heat thereof is used thereby to increase the heat efficiency and the energy efficiency of the system.

A gas hydrate is transported to the object 2 to be cooled from the gas hydrate transportation line 10 connected to the formation device 1 where the gas hydrate is formed; and at this time, a carrier fed into the formation device 1 is used to transport the gas hydrate.

The carrier is for transporting a sherbet-like or ice-like gas hydrate below 0° C. in the first circulation loop, or ice separated from the gas hydrate at the separator 3, and the carrier maintains a liquid state at the cooling temperature of the formation device 1 and does not form a gas hydrate.

The carrier may be put into the formation device 1 in advance, or may be fed from a carrier tank (not illustrated) connected to the second ice line 13.

Examples of the carrier include alcohols such as propanol and butanol, and hydrocarbons having 8 to 10 carbons such as octane, nonane and decane; however, it is not limited as long as it can maintain a liquid state at the cooling temperature of the formation device 1 and does not become a gas hydrate. The carrier can be selected in consideration of both its melting point and the cooling temperature at the formation device 1.

The gas hydrate is sent to the object 2 to be cooled through the transportation line 10 to cool the object 2 to be cooled there and is decomposed by itself into ice and gas; and then, it further cools the object to be cooled by endothermic reaction (decomposition latent heat) at the time of decomposition. In the case that there is a plurality of objects 2 to be cooled, the plurality of objects 2 to be cooled is cooled.

A mixed phase of ice and gas after cooling of the object 2 to be cooled is sent together with the carrier to the separator 3 through the mixed phase line 11, and it is separated into gas, ice and carrier. The gas separated at the separator 3 is sent through the second gas line 14 to the compressor 4 to merge with a gas flow of the second circulation loop.

The ice and the carrier separated at the separator 3 are sent through the first ice line 12 and the second ice line 13 to the formation device 1 by driving the pump 30, and thereafter, used for forming a gas hydrate.

The closed loop refrigeration system of the present invention repeats, as described above, the circulation operation of the first and the second circulation loops, and thereby, it enables refrigeration of an object to be cooled in a temperature range down to about −40° C. in the same manner as when a hydrocarbon such as propane is used as a refrigerant.

In addition, as the closed loop refrigeration system of the present invention does not perform refrigeration by use of evaporation heat as in the case of using a hydrocarbon such as propane as a refrigerant, but it performs refrigeration by use of decomposition latent heat generated at the time of decomposition of a gas hydrate, it reduces power consumption to about one-third compared with the case where propane, for example, is used.

Further, the closed loop refrigeration system of the present invention is excellent in being able to also use carbon dioxide which is of small utility value compared to a hydrocarbon such as propane.

INDUSTRIAL APPLICABILITY

The closed loop refrigeration system of the present invention can be used for refrigeration in various plants, various refrigeration devices, heat pumps, various air-conditioning devices, and others.

REFERENCE SIGNS LIST

1 Gas hydrate formation device
2 Object to be cooled
3 Separator
4 Compressor
5 Cooler
6 Decompressor
7 Cooling device

The invention claimed is:

1. A closed loop refrigeration system comprising a gas hydrate formation device, an object to be cooled, a separator, a compressor, a cooler and a decompressor, the system having:

a first circulation loop extending through the gas hydrate formation device, the object to be cooled and the separator and back to the gas hydrate formation device and comprising a gas hydrate line for transporting a gas hydrate having a temperature below 0° C.; and a second circulation loop for gas extending through the gas hydrate formation device, the compressor, the cooler and the decompressor and back to the gas hydrate formation device, wherein the first circulation loop has the gas hydrate line, a mixed phase line for transporting a mixed phase of gas and ice after decomposition of the gas hydrate, and an ice line for transporting ice after the ice is separated from gas by the separator, and an object to be transported in each line of the first circulation loop is transported together with a same liquid carrier, and wherein the second circulation loop has a first gas feed line branched between the gas hydrate formation device and the compressor for sending gas to the gas hydrate formation device from the second circulation loop, and a second gas feed line connected for sending the gas separated by the separator to the compressor.

2. The closed loop refrigeration system according to claim 1, wherein the liquid carrier maintains a liquid state at a cooling temperature in the gas hydrate formation device and does not form a gas hydrate.

3. The closed loop refrigeration system according to claim 2, wherein the liquid carrier is an alcohol or a hydrocarbon having 8 to 10 carbons.

4. The closed loop refrigeration system according to claim 1, wherein the first circulation line is connected to a plurality of objects to be cooled.

5. The closed loop refrigeration system according to claim 1, wherein the cooler is of a water cooling system or an air cooling system.

* * * * *